US005123782A

United States Patent [19]

Yoshida et al.

[11] Patent Number: 5,123,782

[45] Date of Patent: Jun. 23, 1992

[54] METHOD OF IMPROVING GROUND OF LARGE AREA

[75] Inventors: Hiroshi Yoshida, Tokorozawa; Mitsuhiro Shibazaki, Tokyo; Hiroaki Kubo, Nakamuraminami; Shunji Jinbo, Koyama, all of Japan

[73] Assignees: Kajima Corporation; Chemical Grouting Company, both of Tokyo, Japan

[21] Appl. No.: 741,976

[22] Filed: Aug. 6, 1991

[30] Foreign Application Priority Data

Jan. 27, 1989 [JP] Japan ..... 1-16323

[51] Int. Cl.[5] ..... E02D 5/30

[52] U.S. Cl. ..... 405/233; 405/269; 405/267; 405/240

[58] Field of Search ..... 405/267, 269, 266, 263, 405/240, 232, 233

[56] References Cited

U.S. PATENT DOCUMENTS

| | | | |
|---|---|---|---|
| 3,786,641 | 1/1974 | Turzillo | 405/269 X |
| 4,043,830 | 8/1977 | Suzuki | 405/269 X |
| 4,084,648 | 4/1978 | Yahiro et al. . | |
| 4,449,856 | 5/1984 | Tokoro et al. | 405/269 |
| 4,624,606 | 11/1986 | Nakanishi et al. | 405/269 |
| 4,630,972 | 12/1986 | Kinnan | 405/269 |
| 4,732,510 | 3/1988 | Louis | 405/269 |
| 4,786,212 | 11/1988 | Bauer et al. | 405/269 |

*Primary Examiner*—Randolph A. Reese
*Assistant Examiner*—J. Russell McBee
*Attorney, Agent, or Firm*—Beveridge, DeGrandi & Weilacher

[57] ABSTRACT

The present invention relates to a method for improving the ground of a large area. The method comprises the steps of inserting a pipe into a hole previously dug in the ground, injecting a high pressure liquid and a ground improving injection liquid from an injecting apparatus attached to the tip of the pipe, drawing up the pipe, grouting the ground, and injecting the ground improving injection liquid to thereby form an underground columnar consolidation body for improving the ground. The drawing-up operation of the pipe is executed while applying vertical vibration to the pipe. Thus, a consolidation body of a large area for improvement of the ground is obtained without concave and convex portions.

4 Claims, 2 Drawing Sheets

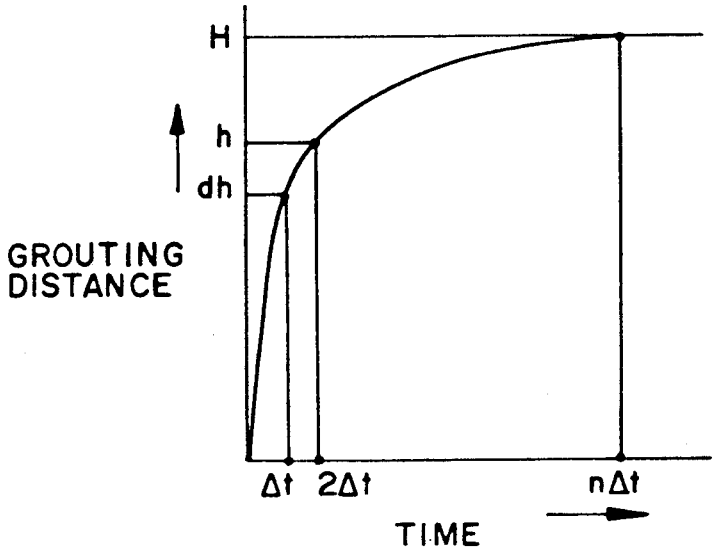
FIG. 2
FIG. 3
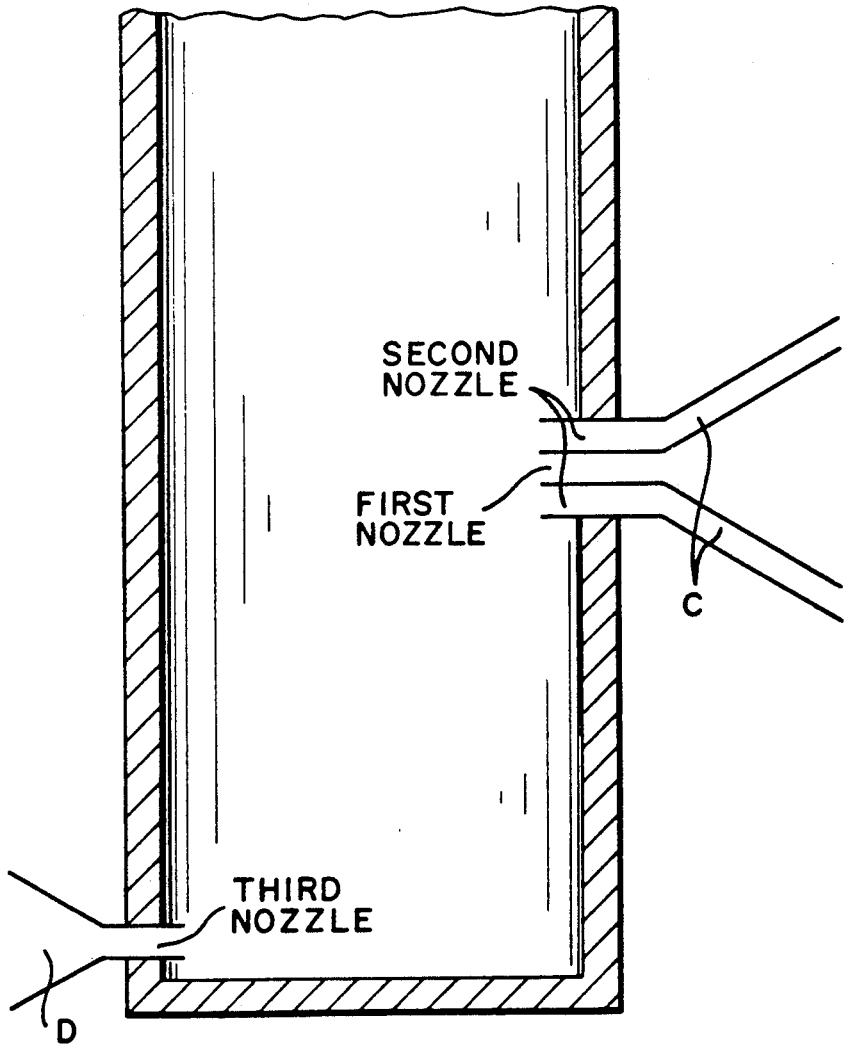

METHOD OF IMPROVING GROUND OF LARGE AREA

This application is a continuation of application Ser. No. 07/471,617, filed Jan. 29, 1990, now abandoned.

FIELD OF THE INVENTION

The present invention relates to the improvement of a method for improving a ground area. The method comprises the steps of: inserting a pipe into a hole previously formed in the ground, injecting both a high pressure liquid and a ground improving injection liquid from an injecting apparatus attached to the tip of the pipe, drawing up the pipe with or without rotation thereof, digging and/or grouting the ground and injecting the ground improving injection liquid therein, forming an underground columnar consolidation body, and thereby improving the ground.

DESCRIPTION OF THE BACKGROUND ART

In a conventional ground improving method for forming a cylindrical ground improved portion, a pipe is drawn up while continuously being rotated. Also, in forming a vertical flat plate-shaped ground improved portion, the pipe is drawn up at a constant velocity without being rotated.

As is well known, in the case of a material like sediment that has a small uniaxial compressive strength and composes unbounded particles, there is an estrangement phenomenon of the grouting operation of the jet due to a grouting shear and a limitation in the grouting performance. Therefore, in the conventional technique, it is impossible to form an underground columnar consolidation body having a large section area or to improve a ground of a large area.

In the conventional technique, when considered from a microscale viewpoint, there are two kinds of portions, one of which is grouted by the jet and another of which is not fully grouted due to insufficient collisions of the jet against the ground. Therefore, there are large concave and convex portions on the surface of the grouted ground and it is impossible to execute a uniform grouting work. If the rotating speed and the drawing-up speed of the pipe are set to slow speeds, such concave and convex portions of the grouted ground can be slightly flattened. However, such slow rotating and drawing-up speeds remarkably deteriorate working efficiency.

Conventional techniques have been proposed in U.S. Pat. No. 4,084,648, entitled "PROCESS FOR THE HIGH-PRESSURE GROUTING WITHIN THE EARTH AND APPARATUS ADAPTED FOR CARRYING OUT SAME", and U.S. Pat. No. 4,047,580, entitled "HIGH-VELOCITY JET DIGGING METHOD".

SUMMARY OF THE INVENTION

It is an object of the present invention to provide a method for improving the ground of a large area by forming a uniform underground columnar consolidation body of large section area without deteriorating working efficiency.

In digging and grouting a ground area by injecting of a jet fluid, it is known that the principle factors necessary to dig and grout the ground are discharge pressure of the fluid, nozzle diameter, nozzle moving velocity, physical property of the material to be grouted, and number of repetition times. With respect to the number of repetition times, assuming that an arrival distance of the jet stream at the first time is set to 1, the grouting distances at the repetition times of two to n are set to 1.2 to 1.3. Assuming that a grouting distance is set to L, the number of repetition times is set to N and a constant is set to C, the grouting distance L can be obtained by the following equation:

$$L = C \cdot N^{0.3}$$

According to the large-area, ground-improving method of the present invention, a pipe is inserted into a hole previously formed in the ground. Both a high pressure liquid and a ground improving injection liquid are injected from an injecting apparatus attached to the tip of the pipe. As the pipe is drawn up, the ground is dug and grouted, the ground improving injecting liquid is injected, and an underground columnar consolidation body is formed to thereby improve the ground. The operation for drawing up the pipe is executed while applying a vertical frequency vibration to the pipe.

It is preferable to select the frequency of the vertical vibration within a range from 1–10 kHz so as to correspond to the grouting period of every time. This period depends upon a uniaxial compression strength of the ground. Also, it is preferable to apply the vertical frequency vibration to the pipe by attaching a high frequency vibrator to the upper portion of the pipe and connecting the vibrator to a vibration generating apparatus mounted on the ground.

Since the pipe is drawn up while being vertically vibrated, the jet stream collides with the grouting surface many times and a uniform grouting surface can be obtained. In addition to the grouting distance at the first time, the jet stream collides with the same position of the ground repetitively at the second time through the nth time, so that the grouting distance increases and a relatively uniform grouted surface of ground having high quality can be derived. Also, the operations of discharging grouting shears and mixing and stirring the ground improving injection liquid and sediments are improved.

BRIEF DESCRIPTION OF THE DRAWINGS

FIG. 2 is a graph showing the grouting distance versus the time of a grouting state.

FIG. 3 shows one embodiment of the first, second, and third nozzle.

DETAILED DESCRIPTION OF THE PREFERRED EMBODIMENT

Figure 1:
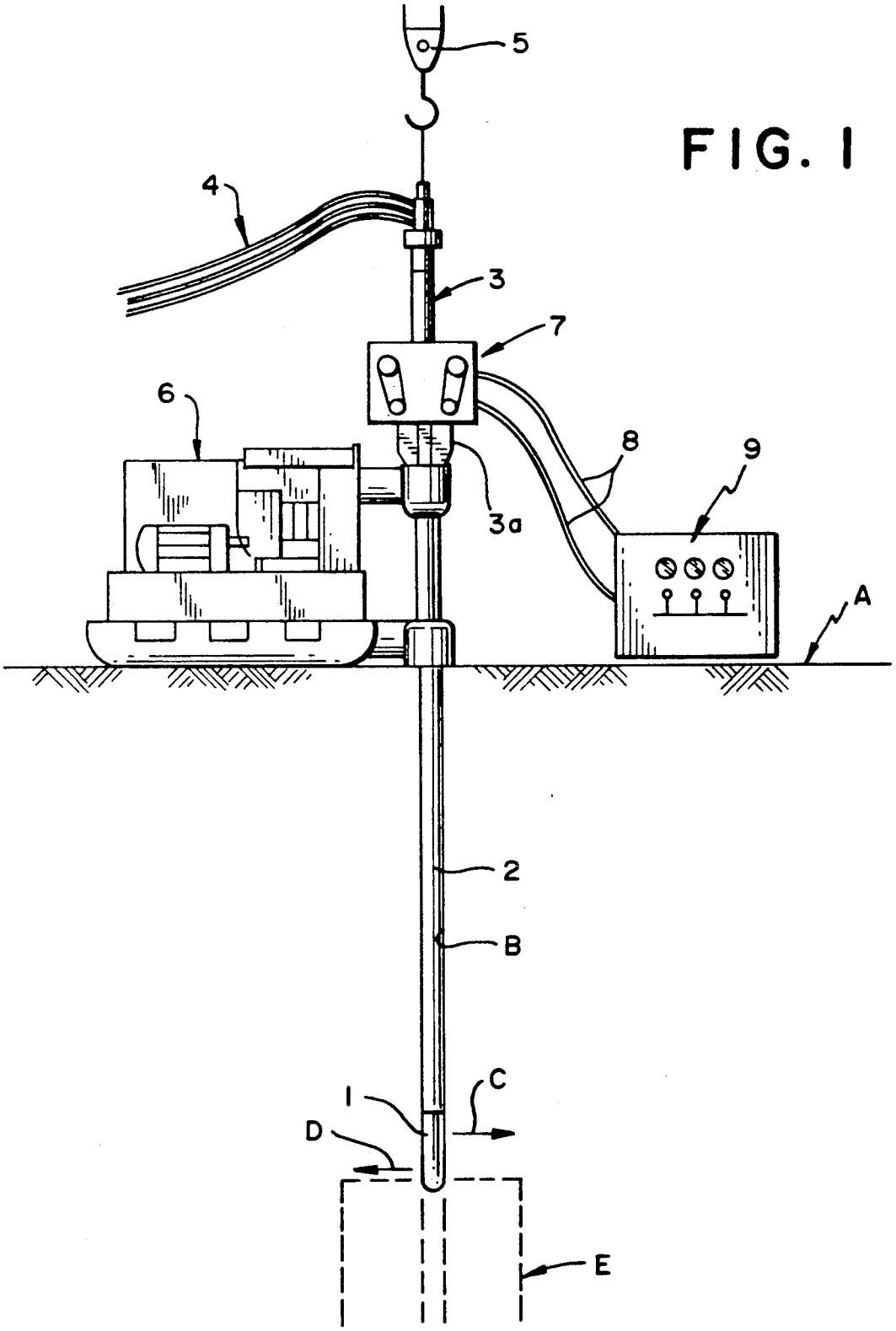
FIG. 1 shows an example of a system embodying the present invention.

FIG. 1 shows a system embodying the present invention. A triple pipe 2 and a triple swivel 3 are sequentially coupled to an upper portion of an injecting apparatus 1 and hung down by a crane 5. Pipes 4 for supplying a high pressure liquid and a low pressure liquid (mainly constituted by, for instance, water) and a ground improving injection liquid (such as basillus, etc.) are connected to the upper end portion of the triple swivel 3.

The triple pipe 2 is rotatably supported by a supporting apparatus 6 and vertically moved by the crane 5. A high frequency vibrator 7 (such as a vibrohammer, etc.) is provided in an upper portion of a swivel portion 3*a* of the triple swivel 3. The high frequency vibrator 7 is coupled through pipes 8 to a vibration generating apparatus 9 installed on the ground. The vibrator 7 applies vertical vibration, having frequencies within a range, for instance, from 1 kHz to 10 kHz, to the injecting apparatus 1 through the triple swivel 3 and triple pipe 2.

In embodying the invention, a hole B is dug at a predetermined position in a ground A by a well-known method. The triple pipe 2 including the injecting apparatus 1 is hung into the hole B by the crane 5 and is hung down by the supporting apparatus 6 while being rotated.

As illustrated in FIG. 3, the high pressure liquid is injected from a first nozzle of the injecting apparatus 1 and the low pressure liquid is injected from second nozzles arranged around the first nozzle, thereby forming a jet stream C. A ground improving injection liquid stream D is injected from a third nozzle. The vertical vibration of the frequencies of 1 kHz to 10 kHz is applied to the injecting apparatus 1 by the vibration generating apparatus 9 and high frequency vibrator 7 through the triple swivel 3 and triple pipe 2. The injecting apparatus 1 is drawn up while being rotated. Thus, the ground A is dug and grouted by the jet stream and the ground improving injection liquid is injected into the grouted space, so that an underground columnar consolidation body E is formed.

In this case, the first and second nozzles of the injecting apparatus are vertically vibrated at the frequencies (e.g., 1 to 10 kHz) corresponding to the colliding period and/or grouting period (i.e., a time period on the order of milliseconds) of the jet stream C. The period required for grouting each time depends upon uniaxial compressive strength of the ground. Therefore, as shown in FIG. 2, although the grouting distance at the first time of the grouting time $\Delta t$ by the jet stream C is dh, the grouting distance to the same position of the ground A at the second time $2\Delta t$ increases to h and the grouting distance at the nth time $n\Delta t$ reaches a saturation distance H. The saturation distance H differs depending upon the uniaxial compressive strength of the ground. The value of H/dh is approximately 1.2 to 1.3, and therefore, the distance H is longer by about 20 to 30% as compared with the grouting distance dh at the first time, that is, the grouting distance in the case of using the conventional technique. On the other hand, the grouting shears are preferably discharged by the repetition of the jet stream, and the grouted sediments and injection liquid are desirably mixed and stirred. Thus, a uniform underground columnar consolidation body E having a large section area, a diameter of which is 20 to 30% larger than the conventional one, is formed.

Since vertical vibration is applied to the injecting apparatus and the jet stream repetitively collides with the same position of the ground, the underground columnar consolidation body having a large section area, with a diameter 20 to 30% larger than one formed by the conventional technique, can be formed. The uniform consolidation body of a large area for improvement of the ground can be formed without concave and convex portions.

What is claimed is:

1. A method for improving a large area of ground, comprising the steps of:

inserting a pipe into a hole previously dug in the ground;

injecting a high pressure liquid for digging the ground and a ground improving injection liquid from an injecting apparatus attached to a tip of said pipe, wherein said high pressure liquid is substantially surrounded by a relatively low pressure liquid;

drawing up said pipe while applying a vertical vibration to said pipe;

grouting the ground;

and injecting said ground improving liquid, thereby forming an underground columnar consolidation body for improving the ground.

2. A method for improving areas of ground comprising the steps of:

inserting a pipe into a previously dug hole;

injecting a high pressure liquid stream for the purpose of digging the ground from an injecting apparatus located at approximately the bottom end of the pipe;

injecting a ground improving liquid from an injecting apparatus located at approximately the bottom end of the pipe, wherein the high pressure liquid stream is surrounded by a relatively low pressure liquid stream;

drawing the pipe up while applying a vertical vibration to said pipe;

grouting the ground; and by the injection of said ground improving liquid forming an underground columnar consolidation body for improving the ground.

3. A method of improving the ground according to claim 2 wherein said vertical vibration is applied by a vibrohammer.

4. A method for improving areas of ground according to claim 2 wherein the liquid stream for cutting the ground and the ground improving liquid are injected from separate nozzles.

* * * * *